United States Patent [19]

Kayss

[11] 4,355,741

[45] Oct. 26, 1982

[54] SACK-FILLING MACHINE

[76] Inventor: Manfred Kayss, Hubertusstr. 30, 3320 Salzgitter 51, Fed. Rep. of Germany

[21] Appl. No.: 132,985

[22] Filed: Mar. 24, 1980

[30] Foreign Application Priority Data

Mar. 29, 1979 [DE] Fed. Rep. of Germany ..... 2912604

[51] Int. Cl.[3] ..... G01F 11/20; B65B 1/04

[52] U.S. Cl. ..... 222/415; 141/313; 198/626

[58] Field of Search ..... 222/415; 141/313, 314, 141/315, 316, 317; 198/626

[56] References Cited

U.S. PATENT DOCUMENTS

| | | | |
|---|---|---|---|
| 1,614,378 | 1/1927 | Micka | 222/415 X |
| 1,979,483 | 11/1934 | Marsh | 222/415 X |
| 2,605,990 | 8/1952 | Peterson | 141/315 X |

FOREIGN PATENT DOCUMENTS

| | | | |
|---|---|---|---|
| 2165513 | 10/1972 | Fed. Rep. of Germany | 222/415 |

*Primary Examiner*—Allen N. Knowles
*Attorney, Agent, or Firm*—Salter & Michaelson

[57] ABSTRACT

A sack-filling machine having a filling tube through which material to be discharged into a sack is to be passed, the filling tube defined by at least one wall and including at least one conveyor belt having a material-feeding run which extends along the inner surface of said wall from a position therein upstream of the downstream end of said filling tube to the vicinity of the downstream end of the filling tube, where the conveyor belt is deflected to form a return run. Conveniently, the conveyor belt is deflected at the downstream end of the filling tube around a curved downstream end of a guide plate mounted inside the filling tube adjacent said wall thereof.

17 Claims, 10 Drawing Figures

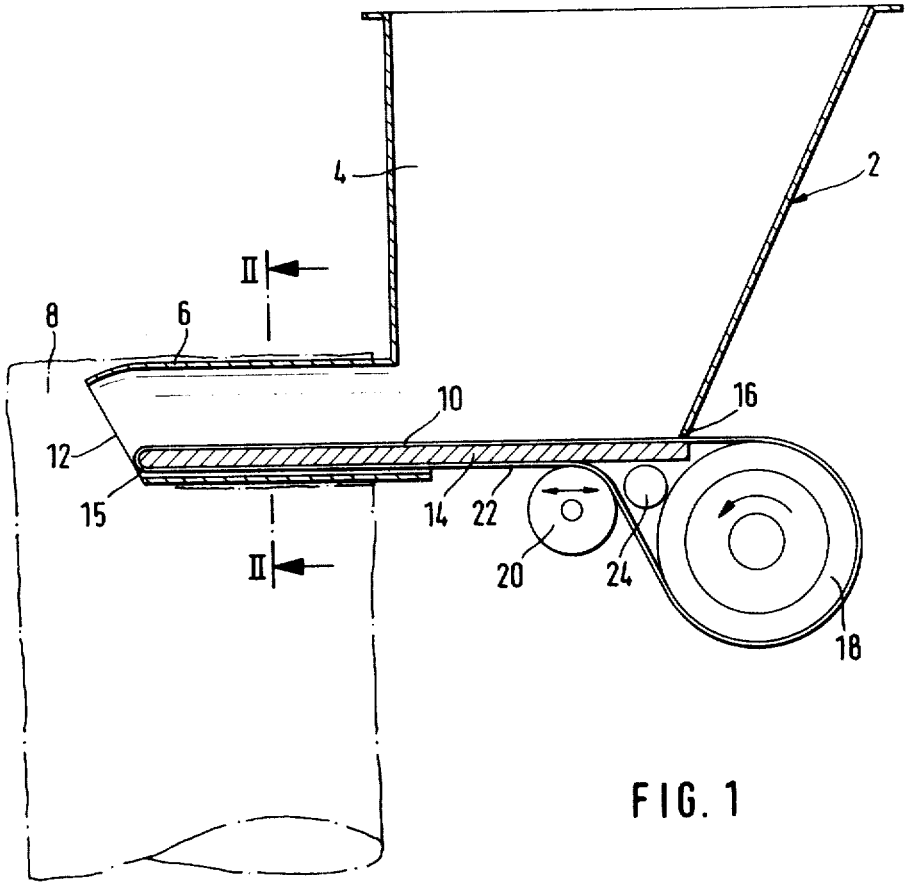
FIG. 1
FIG. 2
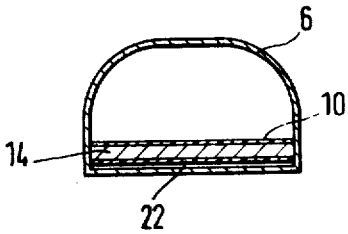

SACK-FILLING MACHINE

FIELD OF THE INVENTION

The invention relates to a sack-filling machine having a filling tube and a conveyor belt for the supply through the filling tube of the material to be filled into sacks.

DESCRIPTION OF THE PRIOR ART

In a known machine of the above-mentioned type, the conveyor belt is one element of a centrifugal belt and acts in conjunction with a fly-wheel in the periphery of which an outwardly-facing U-shaped channel is formed. The fly-wheel is applied with its external circumference against the centrifugal belt so that a closed tubular cross-section and passage is formed which defines the cross-sectional area through which the material is supplied. The centrifugal belt and the fly-wheel are driven at a high speed and accelerate the material to be supplied which is then fed into the sack through the filling tube as a free jet. Filling machines of this type are used in the filling of sacks with a granular or lumpy material, such as granulated sugar or granulated fertilisers, fodder materials or macerated mouldings.

In filling machines having centrifugal belt filling elements, mechanical stress on the material to be filled is unavoidable. In addition, there is also a danger of separation of a pre-mixed material which includes a range of grain sizes of differing masses. Finally the transition between the centrifugal belt filling element and the filling tube creates problems associated with sealing.

Filling machines are also known in which the material to be filled is transported close to the outlet from the filling tube by a screw conveyor. Such screw conveyors also necessarily lead to mechanical stress in the material to be filled. In addition, with abrasive materials the screw conveyors are subjected to considerable wear. The capacity of the screw conveyor is also limited by the particular cross-sectional area of the sack inlet and thus of the filling tube, because due to its constructional nature, the screw of the conveyor, occupies a substantial part of the cross-sectional area of the filling tube 4. Additionally the speed of the screw is limited by the mechanical action of the screw on the material.

It is an object of the invention to devise a sack-filling machine by which it is possible to fill material into sacks at a high flow rate and practically without mechanical stress.

SUMMARY OF THE INVENTION

This object is solved according to the invention by providing a sack-filling machine having a filling tube through which material to be discharged into a sack is to be passed, the filling tube defined by at least one wall and including at least one conveyor belt having a material-feeding run which extends along the inner surface of said wall from a position therein upstream of the downstream end of said filling tube to the vicinity of the downstream end of the filling tube, where the conveyor belt is deflected to form a return run.

It may be convenient to provide the filling tube with at least two conveyor belts mounted on different walls of the filling tube. Thus, in a filling machine having a filling tube arranged substantially horizontally, the base of the filling tube may include two base-defining wall portions inclined in a V-formation and adjacent each of which a conveyor belt is mounted. It is also possible, in a sack-filling machine of this type, to provide the filling tube with a base and two side walls arranged at an angle to it adjacent each of which a conveyor belt is mounted.

Additionally, both in the embodiment with base-defining wall portions inclined in a V-formation and also in the embodiment having side walls arranged at an angle to a base, it is possible to mount a conveyor belt adjacent an upper wall which completes the cross-sectional profile of the filling tube.

In a sack-filling machine according to the invention having a filling tube arranged substantially horizontally, at least those conveyor belts which are mounted on the base-defining wall or wall portions should extend at the upstream end at least as far as the rear edge of a feed hopper supplying the filling tube.

In another convenient embodiment of a sack-filling machine according to the invention the filling tube has a substantially rectangular cross-section and conveyor belts are mounted therein adjacent two opposite walls thereof. In this embodiment the conveyor belts may be designed to be convergent in the downstream direction at least partly in their lengths. In this embodiment the filling tube may be arranged horizontally, inclined or vertically.

In another embodiment in accordance with the invention, the filling tube may be provided with a downwardly-inclined upstream portion forming a feed shaft having a conveyor belt mounted adjacent the upper and lower walls of both the upstream and downstream portions of the filling tube. In this case a continuous conveyor belt may be provided for the upper walls of both the upstream and downstream portions of the filling tube.

In a preferred embodiment, the or each conveyor belt is mounted to run on a guide plate inside the filling tube and is deflected at the downstream end of the filling tube over a rounded downstream edge of the guide plate.

The guide plates may be designed to be of flat or of curved cross-section. It is, for example, possible to design the guide plates in the form of a U having a semicircular base or as a tube slit longitudinally along its top.

BRIEF DESCRIPTION OF THE DRAWINGS

The drawings illustrate several embodiments of the invention which are described by way of example in the following with reference to the drawings.

In the drawings:

FIG. 1 shows schematically in cross-section the filling element of a sack-filling machine in accordance with the invention, FIG. 2 shows a section on the line II—II in FIG. 1;

DESCRIPTION OF THE PREFERRED EMBODIMENTS

Figure 3:
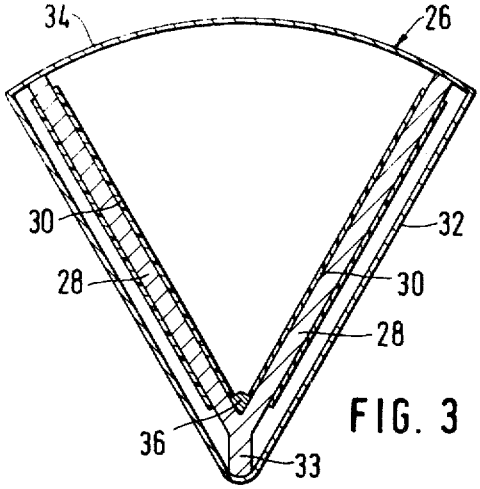
FIGS. 3 to 8 show alternative arrangements of conveyor belts in the filling tube and alternative forms of cross-section of the filling tube.

FIG. 1 shows a filling element 2 having a hopper 4 which communicates at its outlet end with a horizontal filling tube 6 on to which a valved sack or other sack 8 can be connected for filling in the normal way. The base of the hopper 4 is formed by a conveyor belt 10 which extends, at its downstream end, as far as the front edge of the filling tube 6, that is up to its outlet 12. The conveyor belt 10 is mounted on a metal plate 14 and, at its downstream end, is led round a rounded edge 15 of the metal plate 14. At the upstream end the conveyor belt 10 extends as far as the rear wall 16 of the hopper and is there led round a driving roller 18. On the underside of the metal plate 14 the conveyor belt is led round a tension roller 20 which holds the returning length 22 of the conveyor belt parallel to the underside of the metal plate 14 and which is also adjustable in the direction of the arrow to adjust the tension of the conveyor belt when a possibility for the adjustment of tension is not provided in the mounting of the driving motor of the driving roller 18. As is shown in FIG. 2, the metal plate 14 is arranged inside the filling tube 6 and, in particular, in such a way that it is applied against the side walls of said tube. The metal plate 14 may be held by means of screws which are led through the straight portions of the side walls of the filling tube 6. The conveyor belt 10 may be a textile belt coated or impregnated with polyurethane and may have a wall thickness of, for example, between 0.8 and 1.5 mm. Such belts have high elasticity and a low coefficient of friction so that they can be turned through small radii without roller bearings. Such belts operate reliably with semicircular deflections having a radius as small as 3 mm. The guide plate 14, which is preferably of polished nickel-chrome steel, thus needs to have a thickness of only 6 mm.

The conveyor belt 10 can be driven at speeds up to 2 m/s and thus can deliver the material falling into the hopper 4 with a correspondingly high delivery capacity into the sack 8 attached to the filling tube 6. In this embodiment the material to be conveyed to the sack rests predominantly on the conveyor belt moving towards the outlet end of the filling tube. Friction is produced only at the outside of the conical heap of material towards the side walls of the filling tube 6. The material is thus transported without movement relative to the conveyor belt and without mechanical stress as far as the outlet end of the filling tube. The material is thus mechanically stressed to only a negligible degree. Because of the transport without movement relative to the conveyor belt no separation of the material if it has been premixed takes place.

For goods which tend to abrade, cleaning of the underside of the conveyor belt 10 may be achieved in the region between the tension roller 20 and the driving roller 18, for example by means of a suction tube 24 which is introduced into this intermediate region and which can, where necessary, be supplemented by a brush or like cleaning means. Obviously the intermediate space may be enlarged for this purpose by means of an additional deflecting roller.

In FIG. 1 the filling tube 6 is shown as being connected rigidly to the hopper 4. In filling machines having branches, the filling tube 6 may be designed to be separate from the hopper 4. In this case, the guide plate 14 for the conveyor belt 10 may also be interrupted in the region of separation of the branches.

For especially sensitive material it may be convenient to support the whole mass of the material on the conveyor belt and thus to prevent any friction with the fixed walls of the filling tube or other fixed walls. Such an embodiment is illustrated in FIG. 3. In this case the filling tube 26 has a V-shaped base with two base-defining portions 28 adjacent each of which a conveyor belt 30 is mounted. The two base-defining portions 28 combine at their lower ends to form a bar 33 in the region of their joint. The whole arrangement is enclosed by a filling tube casing 32, the upper wall 34 of which may be arched. In this embodiment the whole weight of the material rests on the two conveyor belts 28. The lower longitudinal edges of the conveyor belts may be applied at the inner sides thereof with respect to the filling tube against a guiding fillet 36. Corresponding guiding protuberences may be provided on the outer sides of the base-defining portions 28.

In a further development of the embodiment according to FIG. 3, the cross-section 38 of the filling tube 40, here substantially triangular, may also be provided with a conveyor belt 42 on its upper side. Thus the material within the cross-section 38 of the filling tube is enclosed on all sides by walls moving in the direction of conveyance. In this embodiment the upper conveyor belt may, for example, be so designed as to produce a certain compression of the material. For this purpose the conveyor belt 42 may be mounted so as to converge towards the other conveyor belts over a part of its upstream end.

Figure 4:
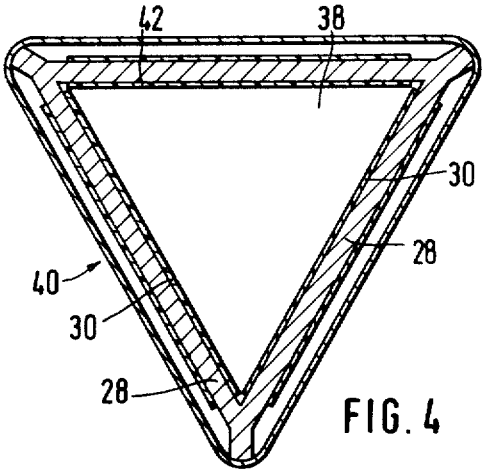
Figure 5:
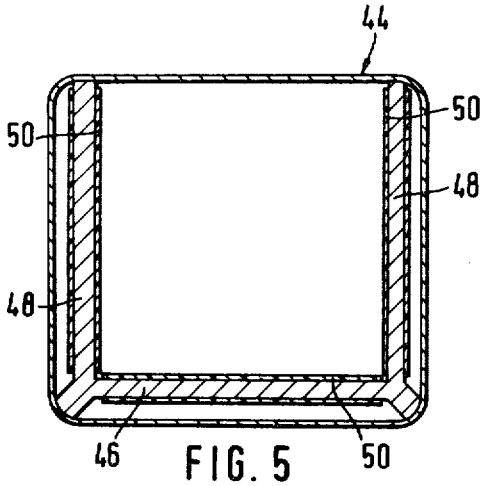

The same effect, as is brought about by the embodiment shown in FIG. 3, is achieved by the embodiment shown in FIG. 5. Here, the filling tube 44 has a substantially rectangular cross-section. At the base there is a guide plate 46, analogous to the guide plate 14 in the embodiment shown in FIGS. 1 and 2. Here, the guide plate 46 forms the crosspiece of a U-shaped cross-section having arms 48 which are again formed as guide plates on each of which lateral conveyor belts 50 are mounted. The lateral guide plates 48 may, as illustrated, be situated perpendicular to the base plate 46, but they may also slope inwards or outwards. The embodiment shown in FIG. 5 has the advantage that, for a given circumference, which is, in general, given by the filling opening of a paper sack, for example by a valve opening therein, a larger conveyor cross-section can be achieved in comparison with the embodiments shown in FIGS. 3 and 4.

Figure 6:
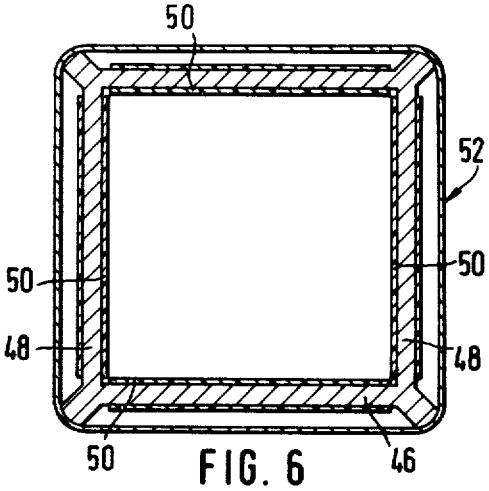

In the embodiment shown in FIG. 6, the conveyor cross-section is, like the embodiment shown in FIG. 4, enclosed on all sides by conveyor belts. The filling tube 52 is again square in this case.

Figure 7:
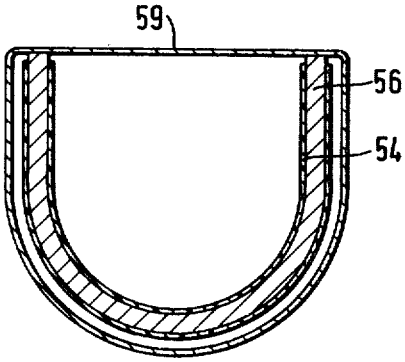

Conveyor belts of the type described hereinbefore are elastic to a high degree and can be led round curved edges. It is thus possible, for example, to design the guide plate in the embodiment shown in FIG. 1 with a downward curve in cross-section, thereby to achieve more favourable cross-sections of the filling tube. Because of the high elasticity of the conveyor belt, the guide plate, as is illustrated in FIG. 7, may also be designed in the form of a U with a semicircular base. The profiling of the cross-section of the conveyor belt 54 is here determined by the deflection edge at the front end of the guide plate 56. The vertical arms of the guide plate 56 may be designed to diverge outwards in the neighbourhood of the hopper and, in particular, in such a way that the guide plate is designed to be substantially flat in the region of the rear end of the hopper so that the conveyor belt may be driven over a cylindrical driving roller. The returning length may be guided as required by suitable guide- and tension-rollers.

Figure 8:
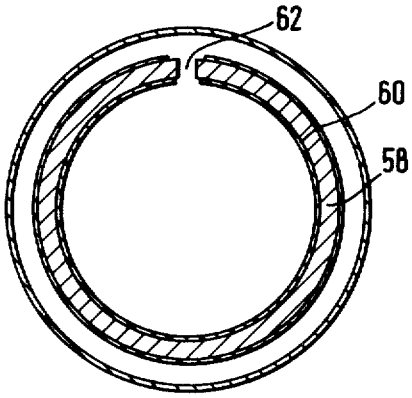

In a further development of the embodiment shown in FIG. 7 it is also possible, as is illustrated in FIG. 8, to design the guide plate 58 in the region of the filling tube 60 as a tube where a slot 62 would be arranged in the upper region. This profile of the supporting plate 58 may also develop continuously to a flat plate towards the rear end of the conveyor belt.

Figure 9:
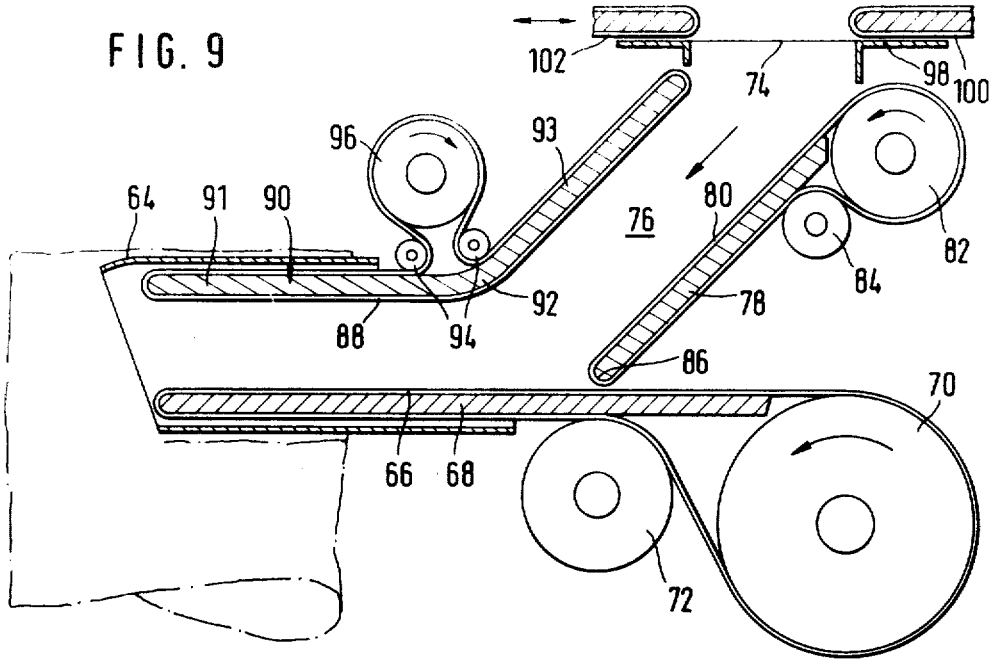
FIG. 9 shows a modified embodiment of the filling station of a sack-filling machine in accordance with the invention.

In the embodiment shown in FIG. 9, a filling tube 64 is provided which may have, for example, a substantially square cross-section, that is it may have a cross-section similar to those in the embodiments shown in FIGS. 5 and 6. A lower conveyor belt 66 runs over the base of the filling tube 64 on a guide plate 68. The arrangement is substantially similar to that shown in FIG. 1. A driving roller 70 and a deflection roller 72 are provided which may also serve as tension rollers.

A sloping feed shaft 76 leads from an intake opening 74 to the filling tube 64. This feed shaft is bounded at its rear side by a guide plate 78 over which there is guided a conveyor belt 80 engaging a driving roller 82 and a deflection roller 84. The lower end of the guideplate 78 has a rounded deflection edge 86. The upper wall of the feed shaft 76 is bounded by a guide plate 90 which is designed in angled form and which has an arm 91 which extends into the region of the upper wall of the filling tube 64 as far as the front edge of said tube. A conveyor belt 88 is guided around the guide plate 90, is led in the region of the apex of the angle 92 of the guide plate 90 over two deflection rollers 94 and loops around a driving roller 96 in this same region.

In this embodiment, the material is moved by the oppositely situated conveyor belts 80 and 88 in the region of the sloping feed shaft 76 and is fed to the horizontal section which is bounded in the region of the filling tube 64 by the conveyor belts 66 and 88.

In this embodiment, the feed shaft 76 may, for example, be designed to converge in the direction of feed. This convergence may be fixed. It is, however, also possible, for example, to arrange the conveyor belt 80 in such a way as to be capable of pivoting, whereby the angle of convergence can be varied.

Alternatively, convergence of the conveyor belts within the feed shaft 76 may also be achieved by making the two arms 91, 93 of the guide plate 90 hinged at the apex 92 of the angle so that the outward sloping arm 93 can be pivoted about this hinge to make the entry angle between the conveyor belts in the feed shaft 76 adjustable.

The convergence of the two bounding walls of the feed shaft 76, formed by the conveyor belts will, in addition, produce a forced feeding by means of which the conveyor effect through the filling tube is improved so that it becomes possible to feed and to convey material which is easily adherent.

If the material to be filled flows with difficulty it may also be convenient to arrange oppositely-moving conveyor belts 100, 102 which operate to discharge material towards the opening 74, on the base of a filling bunker or intermediate bunker situated above the connecting flange 98. The conveyor belts 100, 102 may either be horizontal or slope at an angle towards the inlet 74. By means of these oppositely-moving conveyor belts, a uniform throughput is achieved from the bunker and separation of a mixed material is prevented. The two conveyor belts 100 and 102 may also serve to adjust the cross-section of the inlet 74. For this purpose at least one of the conveyor belts may be designed to be adjustable in the longitudinal direction as is indicated by the double arrow on the conveyor belt 102.

Summarising, it is possible by means of any of the conveyor belts provided in the sack-filling machines according to the invention, the arrangement and mutual slope of which can be adjusted over a wide range, to adjust the conveyance of the material to be passed through the filling tube in sack-filling machines optimally to the material to be handled at any time. It is possible in this way to fill sacks even with such materials which are impossible to fill into sacks with filling devices known hitherto.

Figure 10:
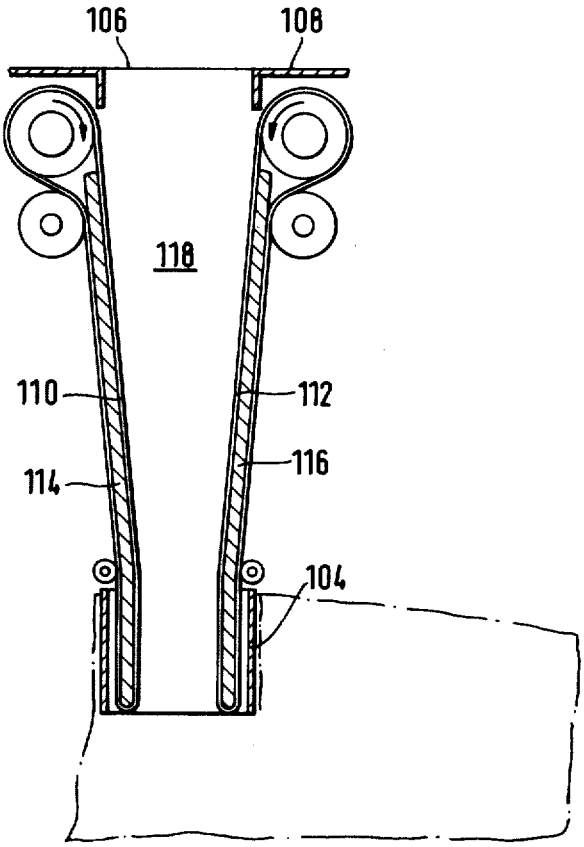
FIG. 10 shows another embodiment with a filling tube arranged vertically of a sack-filling machine.

FIG. 10 illustrates an embodiment having a filling tube 104 directed vertically downwards. In this case there are provided, below the filling opening 106 formed in a flange 108, two conveyor belts 110, 112 driven in opposite directions which run on guide plates 114, 116 and which are provided with guide rollers and tension rollers. The walls which bound the feed shaft 118 perpendicular to the planes of the conveyor belts can be designed to be rigid. It is, however, also possible to design the feed shaft with three or four belts thus having a cross-section substantially similar to those of FIGS. 4 and 6. In the embodiment shown in FIG. 10, the feed shaft 118 converges towards the output end. It is also possible in this case for conveyor belts analogous to the conveyor belts 100 and 102 of the embodiment of FIG. 9, which feed in the direction of the input opening 106, to be arranged above the connecting flange 108 in the base of an intermediate bunker or like container.

What I claim as my invention and desire to secure by Letters Patent of the United States is:

1. A sack filling machine comprising:

a. a filling tube having a downstream end which is receivable in a sack, said tube including at least one wall;

b. a guide plate which extends a distance through said tube along the inner surface of said wall from a point upstream of the downstream end of said tube to a point adjacent said downstream end, said guide plate terminating in a rounded downstream edge; and c. a conveyor belt which extends along said plate in said tube to a point adjacent the downstream end of said tube and around said rounded edge, whereby when the downstream end of said tube is received in said sack said conveyor belt also extends a distance into said sack so that upon activation of said conveyor belt it is operable to transport material thereon through said tube to the downstream end thereof and into said sack.

2. A sack-filling machine according to claim 1, in which the filling tube includes at least two conveyor belts, each mounted on a different wall defining said filling tube.

3. A sack-filling machine according to claim 1 in which said filling tube extends substantially horizontally and has a wall defining the base of said filling tube formed by two base-defining wall portions inclined at an angle to each other in the form of a V and a pair of said conveyor belts, a different one of said conveyor belts mounted adjacent each of said base-defining portions.

4. A sack-filling machine according to claim 3 in which said filling tube has an upper wall and a said conveyor belt mounted adjacent said upper wall of said filling tube, thereby to complete the cross-sectional profile of said filling tube.

5. A sack-filling machine according to claim 1 in which said filling tube is defined by a base wall and a pair of side walls each positioned at an angle to said base wall and a plurality of said conveyor belts, a different one of said conveyor belts mounted adjacent each of said base and side walls.

6. A sack-filling machine according to claim 5 in which said filling tube has an upper wall and a said conveyor belt mounted adjacent said upper wall of said filling tube, thereby to complete the cross-sectional profile of said filling tube.

7. A sack-filling machine according to claim 1 having a feed hopper from which said filling tube extends substantially horizontally, said filling tube having a base defined by at least one said wall and having said conveyor belt mounted on said one wall with said feeding run of said conveyor extending along the inner surface of said one wall from a position beneath said hopper to the downstream end of said filling tube.

8. A sack-filling machine according to claim 1 in which said filling tube has a substantially rectangular cross-section, each side thereof defined by a wall of which two oppositely-facing walls each constitute one of said filling tube-defining walls and each has one of said conveyor belts mounted adjacent to it.

9. A sack-filling machine according to claim 8, in which the feeding runs of said conveyor belts are convergent in the downstream direction at least partly in their lengths.

10. A sack-filling machine according to claim 8 in which said filling tube is substantially horizontal, said pair of oppositely-facing walls are upright side walls and a further said conveyor belt is mounted on a wall defining the base of the filling tube.

11. A sack-filling machine according to claim 9 in which said filling tube is substantially horizontal, said pair of oppositely-facing walls are upright side walls and a further said conveyor belt is mounted on a wall defining the base of the filling tube.

12. A sack-filling machine according to claim 8 in which said filling tube is substantially vertical.

13. A sack-filling machine according to claim 9 in which said filling tube is substantially vertical.

14. A sack-filling machine according to claim 1 having a downstream portion which is substantially horizontal and a downwardly inclined upstream portion each having upper and lower filling tube-defining walls and one of said conveyor belts associated with each said wall.

15. A sack-filling machine according to claim 14, in which a continuous conveyor belt is provided for the upper walls of both said upstream and said downstream portions of said filling tube.

16. A sack-filling machine according to claim 1 in which each said guide plate is flat in cross-section.

17. A sack-filling machine according to claim 1 in which each said guide plate is curved in cross-section.

* * * * *